US010616961B2

(12) United States Patent
Celik et al.

(10) Patent No.: US 10,616,961 B2
(45) Date of Patent: Apr. 7, 2020

(54) SIDE WIRE RACK FIXING DEVICE FOR A COOKING APPLIANCE WITH MICROWAVE HEATING FUNCTION

(71) Applicant: ARCELIK ANONIM SIRKETI, Istanbul (TR)

(72) Inventors: Aziz Celik, Istanbul (TR); Yasin Sedat Yirmili, Istanbul (TR); Servet Turgut, Istanbul (TR); Turgut Yerlikaya, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 172 days.

(21) Appl. No.: 15/766,711

(22) PCT Filed: Nov. 6, 2015

(86) PCT No.: PCT/EP2015/075911

§ 371 (c)(1),
(2) Date: Apr. 6, 2018

(87) PCT Pub. No.: WO2017/076464

PCT Pub. Date: May 11, 2017

(65) Prior Publication Data

US 2018/0288835 A1 Oct. 4, 2018

(51) Int. Cl.
*H05B 6/64* (2006.01)
*F24C 15/16* (2006.01)

(52) U.S. Cl.
CPC ..... *H05B 6/6408* (2013.01); *F24C 15/16* (2013.01)

(58) Field of Classification Search
CPC ..... H05B 6/6408; H05B 6/6474; F24C 15/16; F24C 15/168

(Continued)

(56) References Cited

U.S. PATENT DOCUMENTS 2,671,004 A * 3/1954 Chadwick ..... A47J 37/06 126/339
3,789,826 A * 2/1974 Baltz ..... F24C 15/16 126/339

(Continued)

FOREIGN PATENT DOCUMENTS

DE 102013214854 A1 2/2015
EP 2713108 A2 4/2014
EP 2757322 A1 7/2014

OTHER PUBLICATIONS

International search report and written opinion, dated Jul. 11, 2016, of International Application No. PCT/EP2015/075911; 9 pgs.

*Primary Examiner* — Hung D Nguyen
(74) *Attorney, Agent, or Firm* — Kilpatrick Townsend & Stockton LLP

(57) ABSTRACT

The present invention relates to a fixing device for use in a cooking appliance with microwave heating function, comprising a chamber and side wire racks which are disposed onto the opposing side walls of the chamber. The fixing device of the present invention comprises a heat resistant and electrically insulating retaining member for keeping the respective side wire rack at a discharge safe distance from the side wall; a groove which is formed into the retaining member and adapted to fit to the side wire rack; a metallic fastener for fastening the retaining member to the respective hole on the side wall without contacting the respective side wire rack and a bore which is formed into the retaining member and adapted to receive and insulate the fastener against discharge.

7 Claims, 2 Drawing Sheets

Figure 1:
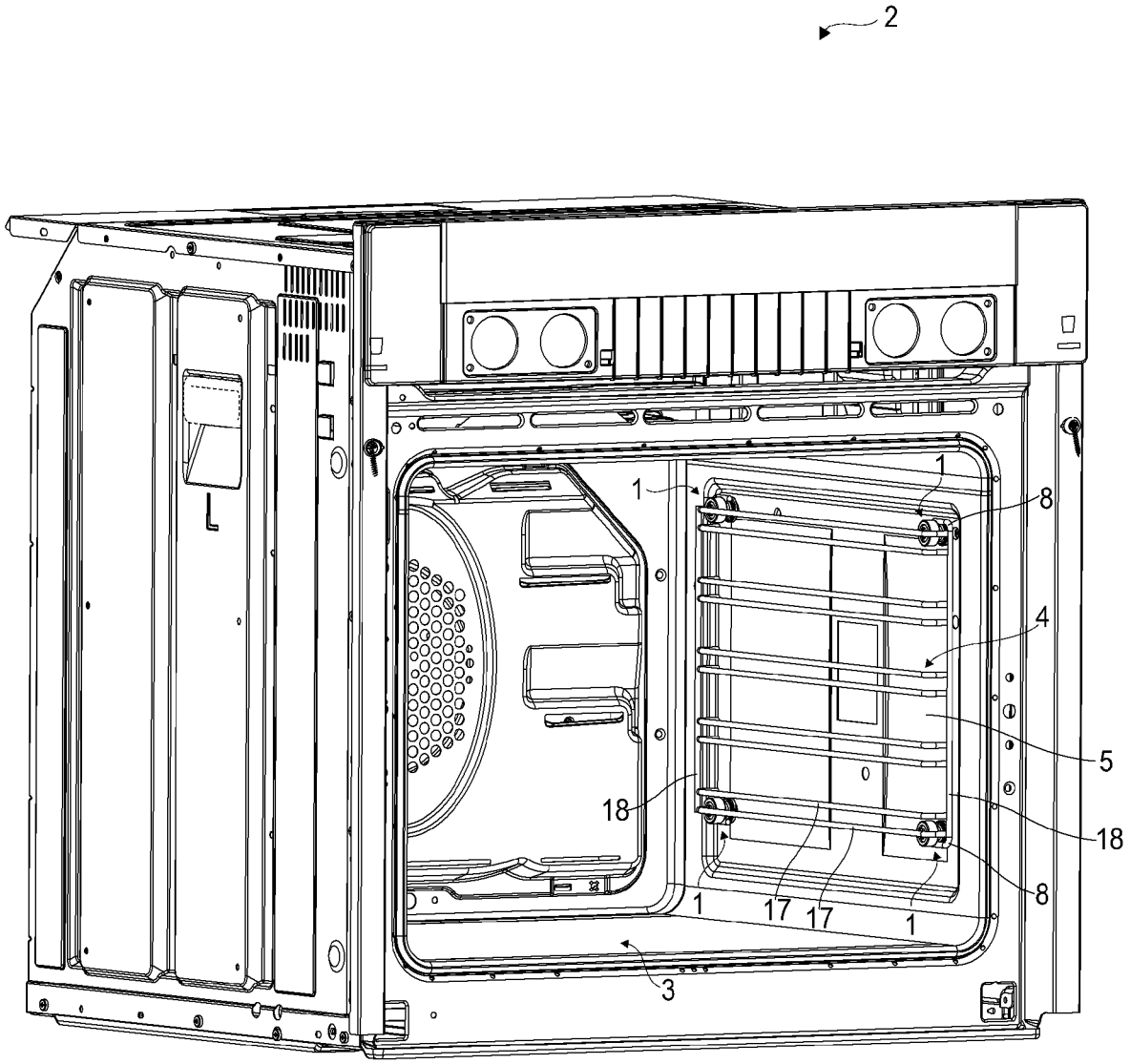

(58) Field of Classification Search
USPC ..... 219/392, 400, 402, 404, 449.1, 452.11, 219/678, 681, 732, 752, 753, 762, 763; 126/19 R, 273 R, 332, 333, 337 A, 337 R, 126/338, 339
See application file for complete search history.

(56) References Cited

U.S. PATENT DOCUMENTS

| | | | | |
|---|---|---|---|---|
| 3,936,627 | A * | 2/1976 | Fitzmayer | F24C 15/16 219/763 |
| 4,434,344 | A * | 2/1984 | Dills | H05B 6/6402 126/337 A |
| 6,938,617 | B2 * | 9/2005 | Le | F24C 15/16 126/273 R |
| 7,087,862 | B1 * | 8/2006 | Shaffer | F24C 15/168 219/392 |
| 7,954,424 | B2 * | 6/2011 | Dunn | F24C 15/16 219/400 |
| 2006/0254432 | A1 * | 11/2006 | McLemore | A47J 37/1209 99/448 |
| 2013/0118471 | A1 | 5/2013 | Sprigler | |
| 2014/0231421 | A1 * | 8/2014 | Yang | F24C 15/168 219/763 |

* cited by examiner

SIDE WIRE RACK FIXING DEVICE FOR A COOKING APPLIANCE WITH MICROWAVE HEATING FUNCTION

RELATED APPLICATIONS

This application is a U.S. National Phase of International Application No. PCT/EP2015/075911, filed Nov. 6, 2015, the entire disclosure of which is incorporated by reference herein.

The present invention relates to a cooking appliance, in particular to a cooking appliance which has microwave heating function.

Cooking appliances such as microwave ovens or hybrid ovens with microwave heating functions are commonly known in the art. A cooking appliance with the microwave heating function generally comprises a chamber for cooking the food by means of microwaves. A pair of side wire racks is commonly attached onto the opposing side walls of the chamber by means of respective fasteners so as to slidably support a tray at one or more different levels. The user places the food to be cooked onto the tray and mounts it into the chamber by means of the side wire racks.

US 2013/0118471 A1 discloses an oven with microwave heating function.

A problem with the aforementioned prior art cooking appliance is that the sharp metal objects such as the side wire racks, the trays and the like within the chamber generally pose the risk of spark generation when the microwave heating function is used.

An objective of the present invention is to provide a fixing device for the side wire rack of a cooking appliance which solves the aforementioned problems of the prior art in a cost-effective way and which enables an improved production and assembly as well as an improved cooking efficiency and safety.

This objective has been achieved by the fixing device as defined in claim 1 and the cooking appliance as defined in claim 6. Further achievements have been attained by the subject-matters respectively defined in the dependent claims.

The cooking appliance of the present invention comprises one or more holes which are formed into each side wall, wherein each hole is adapted for installing the respective fixing device of the present invention.

The fixing device of the present invention comprises a retaining member which is made from a heat resistant and electrically insulating material and adapted to keep the respective side wire rack at an electrical discharge safe distance from the side wall of the chamber; a groove which is formed into the retaining member and adapted to fit around a respective bending section of the side wire rack; a fastener which is metallic and adapted to fasten the retaining member to the respective hole on the side wall without contacting the respective side wire rack and a bore which is formed into the retaining member and adapted to receive and insulate the fastener against electrical discharge.

A major advantageous effect of the present invention is that the risk of spark generation at the side wire racks within the chamber has been eliminated. Another major advantageous effect of the present invention is that the leakage of microwave radiation to the outside of the chamber via the side wire racks have been eliminated and the cooking efficiency and the safety of the cooking appliance have been improved. Another major advantageous effect of the present invention is that the fixing device can be easily installed into a cooking appliance with a convectional heating function in which side wire racks are used. Another major advantageous effect of the present invention is that the fixing device can be easily produced and assembled with the cooking appliance.

In an embodiment, the retaining member has a ceramic coating with a metallic core. This embodiment is particularly advantageous as the costs can be reduced and the mechanical strength of the retaining member can be improved. In an alternative embodiment, the retaining member is entirely made from ceramic. Of course, other heat resistant and electrically insulating materials known to those skilled in the art may be used in the retaining member.

In another embodiment, the retaining member is a single piece. This embodiment is particularly advantageous as the assembly process can be expedited and the costs can be reduced both in terms of labor and material.

In an embodiment, the fastener also leads through a heat resistant and electrically insulating bush so as to insulate the same against electrical discharge. This embodiment is particularly advantageous as the safety of the cooking appliance can be further improved.

In another embodiment, the fastener leads through the passage of a metallic rivet on the side wall. This embodiment is particularly advantageous as the rivet secures the side wire rack safely in place and improves their mechanical strength.

In another embodiment, the fastener is connected at its protruding end to a metallic clip which is abutted against the outer surface of the respective side wall of the chamber. This embodiment is particularly advantageous as the clip secures the fastener safely onto the side wall.

In another embodiment, the fastener comprises a threaded bolt. This embodiment is particularly advantageous as the retaining member can be easily secured onto the side wall through the threaded bolt.

In another embodiment, the retaining member is fitted around the bending section that is formed into the vertical wires of the side wire rack. In this embodiment, the vertical wires are respectively joined to the opposite ends of the pairs of horizontal wires which are u-shaped and arranged at different levels so as to slidably support and secure the tray. This embodiment is particularly advantageous as the bending sections can be easily formed into the side wire rack without the need of attaching any auxiliary tabs through welding. Thereby, the production and assembly of the side wire racks have also been improved.

In other alternative embodiments, the cooking appliance is provided as a free-standing type appliance or a built-in type appliance. In other alternative embodiments, the cooking appliance is provided in addition to the microwave heating function with one or more auxiliary heating functions using gas and/or electricity. Of course, the cooking appliance may be alternatively provided as a microwave oven.

Figure 2:
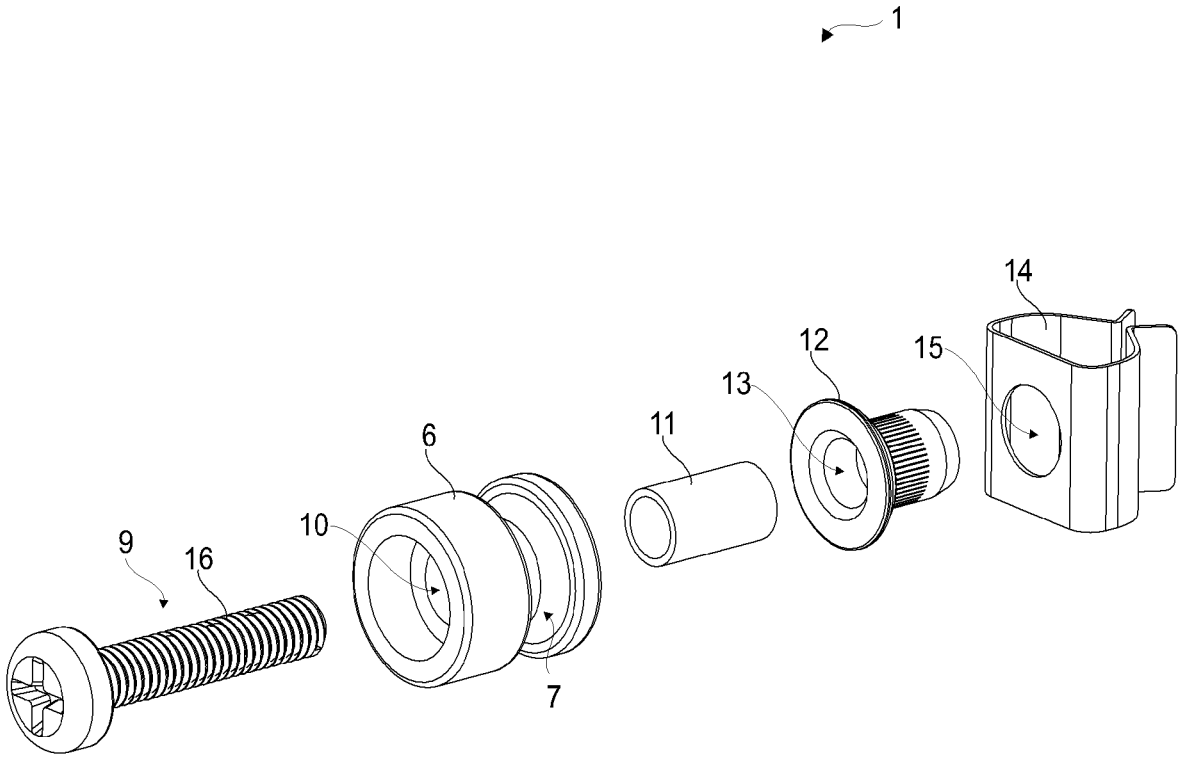

Additional features and additional advantageous effects of the fixing device and the cooking appliance of the present invention will become more apparent with the detailed description of the embodiments with reference to the accompanying drawings in which:

FIG. 1—is a schematic perspective view of a cooking appliance with microwave heating function which has a plurality of fixing devices according to an embodiment of the present invention;

FIG. 2—is a schematic perspective exploded view of a fixing device according to an embodiment of the present invention.

The reference signs appearing on the drawings relate to the following technical features.

1. Fixing device
2. Cooking appliance
3. Chamber
4. Side wire rack
5. Side wall
6. Retaining member
7. Groove
8. Bending section
9. Fastener
10. Bore
11. Bush
12. Rivet
13. Passage
14. Clip
15. Aperture
16. Threaded bolt
17. Horizontal wire
18. Vertical wire The fixing device (1) is suitable for use in a cooking appliance (2) with microwave heating function.

The cooking appliance (2) comprises a chamber (3) for cooking the food by means of microwaves; a magnetron (not shown) for generating microwaves inside the chamber (3); a control unit (not shown) for controlling the magnetron and the temperature inside the chamber (3); a pair of side wire racks (4) which are respectively disposed onto the opposing side walls (5) of the chamber (3) and adapted to slidably support a tray (not shown) at one or more different levels (FIG. 1).

The cooking appliance (2) of the present invention further comprises one or more holes (not shown) which are formed into each side wall (5) and adapted for the installation of the respective fixing device (1) of the present invention.

The fixing device (1) of the present invention further comprises a retaining member (6) which is made from a heat resistant and electrically insulating material and adapted to keep the respective side wire rack (4) at an electrical discharge safe distance from the side wall (5) of the chamber (3); a groove (7) which is formed into the retaining member (6) and adapted to fit around a respective bending section (8) of the side wire rack (4); a fastener (9) which is metallic and adapted to fasten the retaining member (6) to the respective hole on the side wall (5) without contacting the respective side wire rack (4) and a bore (10) which is formed into the retaining member (6) and adapted to receive and insulate the fastener (9) against electrical discharge (FIG. 2).

The cooking appliance (2) of the present invention further comprises one or more fixing devices (1), wherein each fixing device (1) is installed into a respective hole on the side walls (5) (FIG. 1).

In an embodiment, the fixing device (1) comprises a bush (11) which is made from a heat resistant and electrically insulating material. The bush (11) is adapted to be inserted into the bore (10) of the retaining member (6) and into the respective hole of the side wall (5). The bush (11) is further adapted to be fitted around the fastener (9) so as to insulate the same against electrical discharge (FIG. 2).

In another embodiment, the fixing device (1) comprises a rivet (12) which is metallic. The rivet (12) is adapted to be fitted into the respective hole on the side wall (5). The rivet (12) has a passage (13) which is adapted to receive the bush (11) and the fastener (9) (FIG. 2).

In another embodiment, the fixing device (1) comprises a clip (14) which is metallic. The clip (11) is adapted to abut against the outer surface of the respective side wall (5) and to connect with the protruding end of the fastener (9). The clip (14) has an aperture (15) which is adapted to be fitted onto the protruding end of the rivet (14) (FIG. 2).

In another embodiment, the fastener (9) comprises a threaded bolt (16) (FIG. 2).

In another embodiment, each side wire rack (4) comprises one or more pairs of horizontal wires (17) which are u-shaped and arranged at different levels. Each pair of horizontal wires (17) is adapted to slidably support and secure the tray. Each side wire rack (4) further comprises two vertical wires (18) which are respectively joined to the opposite ends of the pairs of horizontal wires (17). In this embodiment, the bending sections (8) of the side wire rack (4) are formed in to opposite ends of the vertical wires (18) so as to fit into the groove (7) of the respective retaining member (6) (FIG. 1).

A major advantageous effect of the present invention is that the risk of spark generation at the side wire racks (4) within the chamber (3) has been eliminated. Another major advantageous effect of the present invention is that the leakage of microwave radiation to the outside of the chamber (3) via the side wire racks (5) have been eliminated and the cooking efficiency and the safety of the cooking appliance (2) have been improved. Another major advantageous effect of the present invention is that the fixing device (1) can be easily installed into a cooking appliance (2) with a convectional heating function in which side wire racks (4) are used. Another major advantageous effect of the present invention is that the fixing device (1) can be easily produced and assembled with the cooking appliance (2). Other advantageous effects of the present invention can be taken from the above-described embodiments.

The invention claimed is:

1. A fixing device for use in a cooking appliance with microwave heating function, the cooking appliance comprising a chamber for cooking food by means of microwaves; a pair of side wire racks which are respectively disposed onto opposing side walls of the chamber and adapted to slidably support a tray at one or more different levels; and one or more holes which are formed into each side wall and adapted for installation of the respective fixing device, the fixing device comprising:

a retaining member which is made from a heat resistant and electrically insulating material and adapted to keep the respective side wire rack at an electrical discharge safe distance from the side wall of the chamber;

a groove which is formed into the retaining member and adapted to fit around a respective bending section of the side wire rack;

a fastener which is metallic and adapted to fasten the retaining member to the respective hole on the side wall without contacting the respective side wire rack; and a bore which is formed into the retaining member and adapted to receive and insulate the fastener against electrical discharge.

2. The fixing device according to claim 1, further comprising a bush which is made from a heat resistant and electrically insulating material and adapted to be inserted into the bore of the retaining member and into the respective hole of the side wall and to be fitted around the fastener so as to insulate the fastener against electrical discharge.

3. The fixing device according to claim 2, further comprising a rivet which is metallic and adapted to be fitted into the respective hole on the side wall and a passage which is formed into the rivet and adapted to receive the bush and the fastener.

4. The fixing device according to claim 3, further comprising a clip which is metallic and adapted to abut against an outer surface of the respective side wall and to connect with a protruding end of the fastener and an aperture which is formed into the clip and adapted to be fitted onto the protruding end of the rivet.

5. The fixing device according to claim 1, wherein the fastener comprises a threaded bolt.

6. A cooking appliance with microwave heating function, comprising:

a chamber for cooking food by means of microwaves;

a pair of side wire racks which are respectively disposed onto opposing side walls of the chamber and adapted to slidably support a tray at one or more different levels;

one or more holes which are formd into each side wall, wherein each fixing device is installed into a respective hole on the side walls; and one or more fixing devices each comprising:

a retaining member which is made from a heat resistant and electrically insulating material and adapted to keep the respective side wire rack at an electrical discharge safe distance from a side wall of the chamber, a groove which is formed into the retaining member and adapted to fit around a respective bending section of the side wire rack, a fastener which is metallic and adapted to fasten the retaining member to the respective hole on the side wall without contacting the respective side wire rack, and a bore which is formed into the retaining member and adapted to receive and insulate the fastener against electrical discharge.

7. The cooking appliance according to claim 6, wherein each side wire rack comprises one or more pairs of horizontal wires which are u-shaped and arranged at different levels, wherein each pair of horizontal wires is adapted to slidably support and secure the tray and two vertical wires which are respectively joined to opposite ends of the pairs of horizontal wires, wherein bending sections are formed into opposite ends of the vertical wires so as to fit into the groove of the respective retaining member.

* * * * *